United States Patent [19]

Masters et al.

[11] Patent Number: 4,942,840

[45] Date of Patent: Jul. 24, 1990

[54] FOOT BRACE FOR KAYAKS

[76] Inventors: William E. Masters, 313 Dogwood La., Easley, S.C. 29640; Roger A. Williams, 327 Pinehurst, Mauldin, S.C. 29662

[21] Appl. No.: 155,596

[22] Filed: Feb. 12, 1988

[51] Int. Cl.[5] ..... B63B 35/72

[52] U.S. Cl. ..... 114/363; 114/347; 297/423

[58] Field of Search ..... 114/363, 347; 441/70; 297/423, 430; 296/75; 280/727; 248/220.2, 246, 243

[56] References Cited

U.S. PATENT DOCUMENTS 3,231,911 2/1966 Clifton ..... 441/70

3,992,738 11/1976 Kiefer ..... 441/70

4,589,365 5/1986 Masters ..... 114/347

*Primary Examiner*—Joseph F. Peters, Jr.

*Assistant Examiner*—Edwin L. Swinehart

*Attorney, Agent, or Firm*—Cort Flint

[57] ABSTRACT

A molded foot brace for a kayak is disclosed having only three major parts which include a molded flange bar (20) having flanges (24, 26) received within a T-shaped channel (44) of an adjustable foot rest bracket (40). A flexible lever (58) is integral with the foot rest bracket and may be flexed to release a cam (50) from within an index opening (22) for adjustably positioning a foot rest (42). A remote cable (72) may be used to operate and release the foot rest from a remote position.

17 Claims, 2 Drawing Sheets

FOOT BRACE FOR KAYAKS

BACKGROUND OF THE INVENTION

The invention relates to a molded adjustable footbrace for a lightweight, flexible skin kayak and the like which may be easily adjusted from the cockpit of the kayak. Kayaks have become increasingly popular for use in whitewater recreational sports. Under whitewater conditions,the kayak undergoes considerable dynamic forces as it drops from high falls, impacts rocks, makes sharp turns, and other rigors involved in whitewater travel. The boater must maintain himself in a stable position with hip, thighs, and feet braced within the kayak. The kayak may be constructed of a thin flexible, yet strong, plastic skin such as disclosed in U.S. Pat. No. 4,227,272. In order for the boater to adequately brace himself in a stable position within the kayak so that he may retain control, the bracing must be provided so that the boater may adjust his position.

Heretofore, numerous foot braces have been proposed for kayaks. In many instances, the foot brace provided requires that the boater be able to reach to the point of the foot rest for adjustment. For example, rails may be attache to interior sides of the kayak hull and foot rests may be removably attached to the rails by various means such as pins. This typically is the point furthest towards the bow of the boat away from the area where the boater is seated. The necessity to reach inwardly is both awkward and often virtually impossible unless the boater is reaching into the kayak from an unseated position. U.S. Pat. No. 2,001,247 discloses a footbrace for a kayak which utilizes a single rail affixed to the kayak with a movable foot rest that may be adjusted in its position along the rail. A plurality of pins must be set to adjust the foot rest in its position. This requires considerable effort and manipulation. While simple in construction, the foot rest may be awkward and troublesome to use. U.S. Pat. No. 3,982,293 discloses a footrest for kayaks including a channel member attached to the kayak and a foot pad unit which slides in the channel member. Simplified and more convenient adjustment of the foot pad along the channel is sought by utilizing the depressing trigger and indexing pin actuated by the trigger. The pin locks in grooves in the channel. There is a likelihood that the pins may pivot out of the indexing slots and the foot pad lose its position. Attempts have been made to provide a footbrace for a kayak which can be adjusted from the cockpit such as shown in Great Britain Pat. No. GB 2,134,454. However,this foot rest requires considerable structure and attachment to the hull and occupies a good bit of the hull interior making such impractical. U.S. Pat. No. 4,229,850 discloses a foot brace having a number of stationary foot positions so that the brace need not be adjusted but that the foot may be adjusted in the brace. However, the need for providing a plurality of foot rests with only a limited variety of positions and the possibility of the boater placing his feet at unequal foot rest positions renders such a device not entirely satisfactory.

Accordingly, an object of the invention is to provide a lightweight foot brace for a kayak which is simple in construction.

Another object of the invention is to provide a lightweight foot brace for a kayak which is easy to operate from a seated position and remains reliably locked in an adjusted position.

Another object of the invention is to provide a molded foot brace for a kayak which is simple in construction and strong in its parts providing a simple and reliable adjustable foot brace for a boater.

SUMMARY OF THE INVENTION

The above objectives are accomplished according to the invention by providing a foot brace for a kayak which includes an elongated flange bar carried by the hull interior extending in forward and aft directions; and an adjustable foot rest bracket slidably carried by the flange bar having a foot rest projecting laterally from the flange bar and outwardly towards a center of the hull interior so that a boater seated in the cockpit may brace a foot on the foot rest. The position of the adjustable foot rest bracket is adjusted along the length of the flange bar by a plurality of index openings formed in the flange bar and a cam carried by the foot rest bracket for engaging within the openings. The cam is formed on one end of a molded one piece operator lever having a flexible stem integrally attached to the adjustable bracket bar in a manner that a flexible joint is created between the operator lever and the adjustable foot rest bracket. An operator portion is formed on the operator lever for moving the cam means in and out of the index openings as the operator lever flexes about the flexible joint.

The foot rest bracket is molded as one piece from a suitable plastic material. The flexible skin of the operator lever terminates in an enlarged head portion having a pair of lateral side extensions. The foot rest bracket has a socket in which the enlarged head of the stem is received and snapped into place. The lateral side extensions abut an interior wall of said socket to lock the stem and adjustable foot rest bracket integrally together. A remote actuation means may be connected to the operator lever for operating the lever from a remote location.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
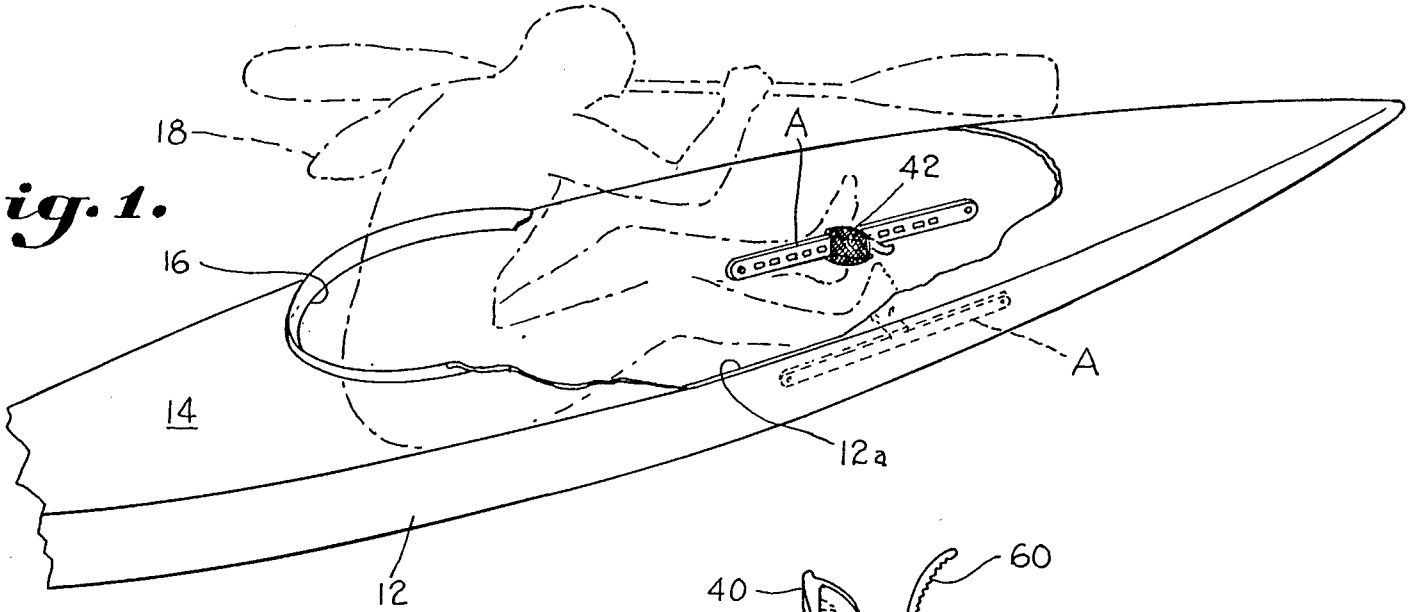
FIG. 1 is a perspective view of a kayak with parts cut away to illustrate a molded foot brace constructed in accordance with the present invention.

Referring now in more detail to the drawings, a kayak 10 is illustrated in FIG. 1 which includes a hull 12 and a deck 14. A cockpit 16 is formed on the deck which may be occupied by boater 18. In this position, the hips of the boater are braced in a seat (not shown) and the thighs against thigh braces (not shown) attached to the inside of the hull. A foot brace A is mounted to the interior sides 12*a* of hull 12 by suitable conventional fasteners.

Figure 2:
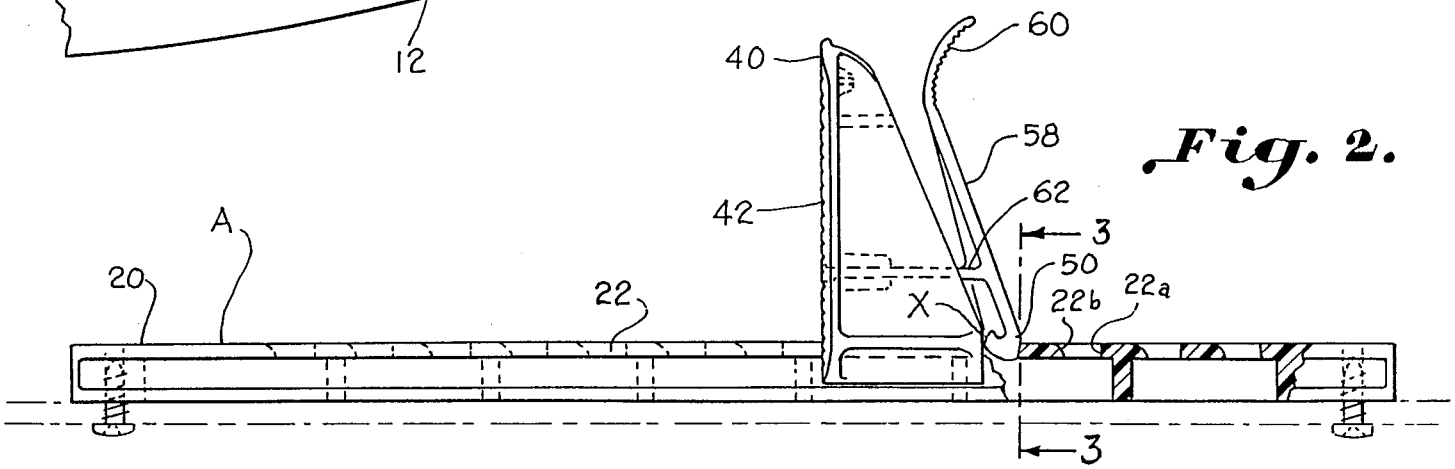
FIG. 2 is a top plan view of a molded foot brace constructed in accordance with the present invention with parts and section.
Figure 3:
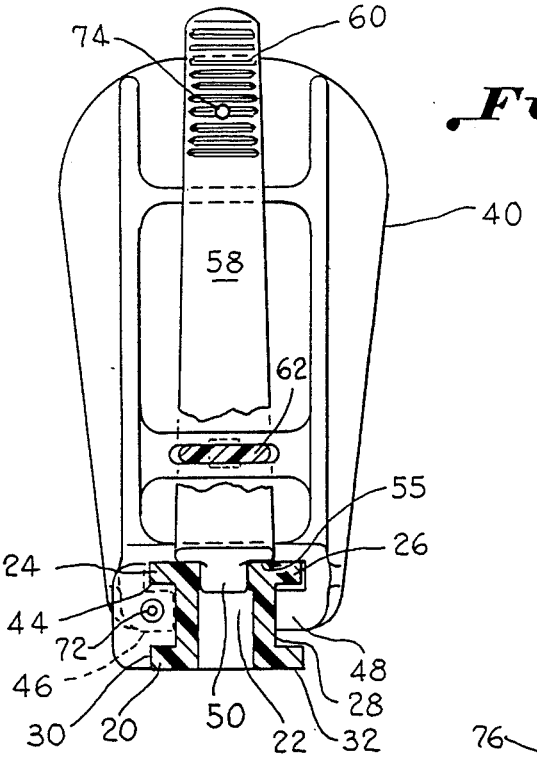
FIG. 3 is a sectional view taken along line 3—3 of FIG. 2.

As can best be seen in FIG. 2, each footbrace A includes an elongated flange bar 20 having a plurality of index openings 22 formed in a medial portion. A pair of flanges in the form of a first flange 24 and a second flange 26 extend outwardly on each side of index openings 22 as can best be seen in FIG. 3. A shank 28 integrally connects flanges 24 and 26 to a base flange having outwardly extending flanges 30 and 32. An adjustable foot rest bracket 40 is slidably received on flanges 24 and 26 of flange bar 20. The bracket includes a foot rest 42. A generally T-shaped channel 44 is formed in the bracket for receiving the correspondingly T-shaped flanges 24, 26 of flange bar 20. Inward projections 46 and 48 slidingly engage shank 28 of flange bar 20. Adjustable foot rest bracket 40 stably slides along flange bar 20. As can best be seen in FIGS. 2 and 4, means for locking foot rest bracket 40 in a desired position includes a cam means 50 which engages within an index opening 22. Shoulders 55 on opposing sides of cam 50 engage corresponding surfaces of flanges 24 and 26 to limit penetration of the cam into index opening 22. Each index opening 22 is defined by a generally flat abutment surface 22*a* and a rounded tapering surface 22*b*. Cam means 50 includes a camming surface 52 which compliments and works with abutment surface 22*a* for locking adjustment bracket 40 in a position with pressure on foot rest 42, as can best be seen in FIG. 2 and 4. Camming means 50 further includes a contoured portion 54 which compliments and works with contoured surface 22*b* for allowing adjustment bracket 40 to slide in a direction opposite arrow 56 shown in FIG. 4 to adjust the position of bracket 40. In addition, an upwardly inclined surface X on cam 50 engages an oppositely, downwardly inclined surface Y on bracket 40 as foot pressure is placed on rest 42 in the direction of arrow 56. The two surfaces X and Y interlock forcing cam 50 to lock tighter in hole 22. Means for releasing cam means 50 includes an operator portion 60 formed on the opposite end of lever 58 for manual operation of lever 58. Intermediate operator portion 60 and cam means 50 is a flexible stem 62 molded as one piece with lever 58 and penetrating into a socket 64 molded as one piece with foot rest bracket 40. As can best be seen in FIG. 3, stem 62 is preferably of a flat rectangular cross-section having rounded edges. Stem 62 terminates in an enlarged head 66 having side projections 68 which engages an inner wall 70 of socket 64 to lock the lever in place on bracket 40. Preferably, foot rest bracket 40 and lever 58 are each molded as one piece from a suitable plastic material and are locked together with socket 64 and enlarged head 66 of stem 62. This provides flexibility to the stem so that it pivots to release cam 50.

Figure 5:
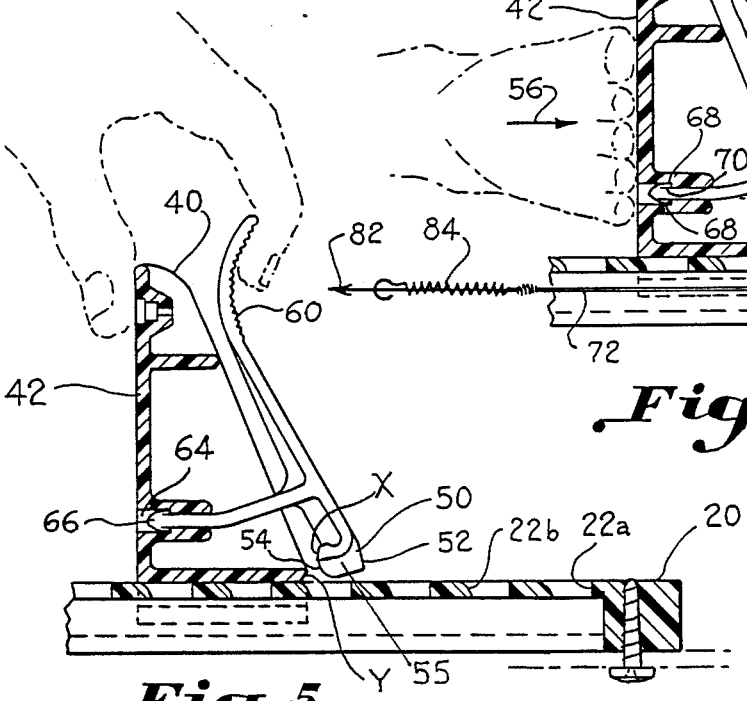
FIG. 5 is a top plan and section illustrating manual operation of an adjustable foot brace in accordance with the invention.

Foot rest bracket 40 may be moved in the direction opposite arrow 56 without operating lever 58. Lever 58 must be operated, as can best be seen in FIG. 5, by pulling the lever toward the boater to move the foot rest in the direction of arrow 56.

Figure 4:
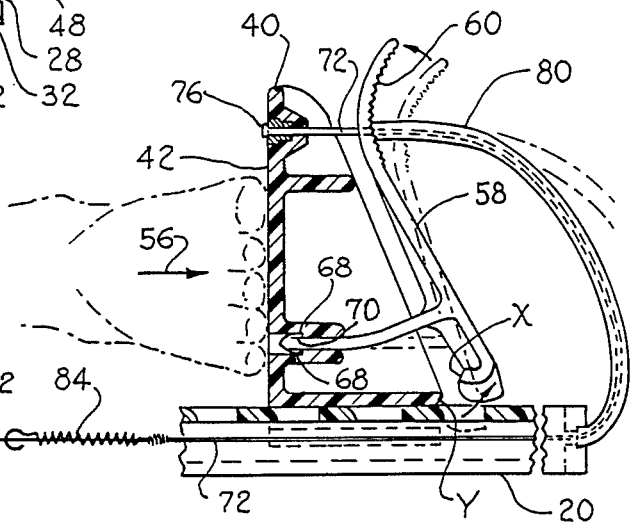
FIG. 4 is a partial top plan view of a foot rest and flange bar of a foot brace constructed in accordance with the present invention illustrating remote operation.

Referring to FIG. 4, remote actuation means for operating lever 58 from a remote location in a convenient simple manner is illustrated. This includes a flexible cable 72 extending through a hole 74 in operator portion 60 of lever 58. Cable 72 may be fastened at 76 to the outer end of bracket 40 in any suitable manner. Cable 72 extends through aligned opening 74 in operator portion 60 into a flexible cable housing 80. Cable 72 may be routed to a vicinity of a seated boater and may be actuated or pulled toward the boater, in the direction of arrow 82, to release lever 58 and cam 50, as can best be seen in FIG. 4. Spring 84 may be provided to keep slack out of the cable 72. Cable 72 may be pulled manually by the boater or a handle (not shown) may be provided to which cable 72 is attached. Cable 72, housing 80, and the handle may be any suitable arrangement, for example, like a conventional bicycle brake cable and handle mechanism which operates to pull the cable 72 in the direction of arrow 82. Cable 72 is routed inside flange bar 20 to keep it out of the way. In this manner, the location of foot rest 42 may be adjusted quickly by the boater without reaching under and into the hull of the kayak merely from a seated position. This allows foot rest 42 to be adjusted while the boater is paddling the kayak and needs to adjust for more or less bracing depending on water conditions.

Thus, it can be seen that an advantageous construction for a foot rest can be had for a kayak according to the invention. The foot brace includes only three parts which may be easily and economically molded. Two of the parts, the foot rest bracket and the operator lever, may be integrally joined to the operator as one piece so that only two major parts need to be installed in the kayak, namely the flange bar and the foot rest bracket. The construction is lightweight, simple to use and may be easily adapted for remote operation. While a preferred embodiment of the invention has been described using specific terms, such description is for illustrative purposes only, and it is to be understood that changes and variations may be made without departing from the spirit or scope of the following claims.

What is claimed is:

1. A foot brace for a kayak of the type having a hull with an upper deck, a cockpit having a cockpit opening in which a boater is seated comprising:

an elongated flange bar carried by said hull inside an interior of said kayak extending in forward and aft directions;

an adjustable foot rest bracket slidably carried by said flange bar having a foot rest projecting laterally from said flange bar and inwardly towards a center of said hull interior so that a boater seated in said cockpit may brace a foot on said foot rest;

means for adjusting the position of said adjustable foot rest bracket along the length of said flange bar including a plurality of index openings formed in said flange bar and a cam means for engaging within said openings;

said cam means being formed on one end of a molded one piece operator lever having a flexible stem integrally attached to said adjustable foot rest bracket in a manner that a flexible joint is created between said operator lever and said adjustable foot rest bracket; and an operator portion formed on said operator lever for moving said camming means in and out of said index openings as said operator lever flexes about said flexible joint.

2. The apparatus of claim 1, wherein said foot rest bracket is molded as one piece from a suitable plastic material.

3. The apparatus of claim 1, wherein said flexible stem of said operator lever terminates in an enlarged head portion having a pair of lateral side extensions; and said foot rest bracket having a socket in which said enlarged head of said stem is received and snapped into place with said lateral side extensions abutting an interior wall of said socket to lock said stem and adjustable footrest bracket integrally together.

4. The apparatus of claim 1, wherein said cam means includes:

a contoured surface contoured for release from said index openings and a camming surface which interlocks with said index opening permitting movement of said adjustable bracket member without actuation of said operator lever in said aft direction.

5. The apparatus of claim 4 wherein said cam means includes a first inclined locking surface and said bracket includes a second oppositely inclined locking surface which interlocks against said first surface when pressure is exerted on said foot rest.

6. The apparatus of claim 1 wherein said cam means includes a first inclined locking surface and said bracket includes a second oppositely inclined locking surface which interlocks against said first surface when pressure is exerted on said foot rest.

7. The apparatus of claim 4, wherein said index openings include a complimentary camming surface for interlocking with said camming surface of said cam means and a complimentary contoured surface for automatically releasing said contoured surface of said cam means.

8. The apparatus of claim 1 including shoulder means formed on said one end of said operator lever adjacent to said cam means for limiting the depth of penetration of said cam means into said index opening.

9. The apparatus of claim 1 including remote actuation means connected to said operator lever for operating said lever from a remote location.

10. The apparatus of claim 8 wherein said cam means includes a first inclined locking surface and said bracket includes a second oppositely inclined locking surface which interlocks against said first surface when pressure is exerted on said foot rest.

11. A foot brace for a kayak of the type having a hull with an upper deck, a cockpit having a cockpit opening in which a boater is seated comprising:

an elongated flange bar carried by an interior surface of said hull extending in a forward and aft direction relative to said kayak hull;

said flange bar including a shank adapted for connection to said hull including a first flange extending outwardly from one side of said shank and a second flange extending outwardly from an opposite side of said shank;

an adjustable foot rest bracket having a foot rest extending inwardly from said flange bar toward the center of the interior of said hull;

said adjustable foot rest bracket having a generally T-shaped groove formed therein for receiving said first and second flanges of said flange bar, and said T-shaped channel being defined in part by a pair of inward projections which generally butt against said shank of said flange bar so that said foot rest bracket may stably adjust along the length of said flange bar; and means for locking said adjustable foot rest bracket at a desired position along the length of said flange bar.

12. The apparatus of claim 11, wherein said means for locking said foot rest bracket in a position includes a flexible lever carried by said foot rest bracket;

a cam means carried by one end of said flexible lever; and index openings formed in said flange bar intermediate said first and second flanges for receiving said cam means in an interlocking manner.

13. The apparatus of claim 12, wherein said adjustable foot rest bracket and said flexible lever are each molded from a plastic material as one piece and are fitted together in an integral manner.

14. The apparatus of claim 11 including remote actuation means connected to said operator lever for operating said lever from a remote location.

15. A foot brace for a kayak of the type having a hull with an upper deck, a cockpit having a cockpit opening in which a boater is seated comprising:

an elongated flange bar carried by an interior surface of said hull extending in a forward and aft direction relative to said kayak hull;

said flange bar including a shank adapted for connection to said hull including a first flange extending outwardly from one side of said shank and a second flange extending outwardly from an opposite side of said shank;

said adjustable foot rest bracket having a foot rest extending inwardly from said flange bar toward the center of the interior of said hull;

said adjustable foot rest bracket having a generally T-shaped groove formed therein for receiving said first and second flanges of said flange bar, and said T-shaped channel being defined in part by a pair of inward projections which generally butt against said shank of said flange bar so that said foot rest bracket may stably adjust along the length of said flange bar; and means for locking said adjustable foot rest bracket at a desired position along the length of said flange bar.

16. The apparatus of claim 15, wherein said means for locking said foot rest bracket in a position includes a flexible lever carried by said foot rest bracket;

a cam means carried by one end of said flexible lever; and index openings formed in said flange bar intermediate said first and second flanges for receiving said cam means in an interlocking manner.

17. The apparatus of claim 16 wherein said cam means includes a first inclined locking surface and said bracket includes a second oppositely inclined locking surface which interlocks against said first surface when pressure is exerted on said foot rest.

* * * * *